US007517052B2

(12) United States Patent
Wada et al.

(10) Patent No.: US 7,517,052 B2
(45) Date of Patent: Apr. 14, 2009

(54) INK-JET HEAD AND INK-JET RECORDING APPARATUS USING THE HEAD

(75) Inventors: Satoshi Wada, Tokyo (JP); Makoto Akahira, Tokyo (JP); Tsuyoshi Shibata, Tokyo (JP); Hiromitsu Yamaguchi, Tokyo (JP); Yoshitomo Marumoto, Tokyo (JP); Ryoki Jahana, Tokyo (JP); Yasunori Fujimoto, Tokyo (JP); Takashi Ochiai, Tokyo (JP); Eri Goto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 431 days.

(21) Appl. No.: 11/007,384

(22) Filed: Dec. 8, 2004

(65) Prior Publication Data

US 2005/0128248 A1 Jun. 16, 2005

(30) Foreign Application Priority Data

Dec. 15, 2003 (JP) ..... 2003-417364

(51) Int. Cl.
*B41J 2/14* (2006.01)
*B41J 2/15* (2006.01)
*B41J 2/155* (2006.01)
*B41J 2/21* (2006.01)

(52) U.S. Cl. ..... 347/49; 347/40; 347/42; 347/43

(58) Field of Classification Search ..... 347/6, 347/9, 12–13, 40, 43, 41–42
See application file for complete search history.

(56) References Cited

U.S. PATENT DOCUMENTS

| | | | | |
|---|---|---|---|---|
| 6,334,665 | B1 * | 1/2002 | Yoshida | 347/40 |
| 6,890,061 | B1 * | 5/2005 | Freire et al. | 347/42 |
| 7,021,732 | B2 * | 4/2006 | Folkins | 347/8 |
| 2002/0024557 | A1 * | 2/2002 | Matsumoto et al. | 347/42 |
| 2002/0109752 | A1 * | 8/2002 | Sato | 347/43 |
| 2002/0140769 | A1 * | 10/2002 | Kuwahara | 347/40 |

FOREIGN PATENT DOCUMENTS

| | | | |
|---|---|---|---|
| EP | 091450 | | 12/1999 |
| JP | 05-057965 | A | 3/1993 |
| JP | 2000-289233 | | 10/2000 |
| JP | 2000-289233 | A | 10/2000 |
| JP | 2002-067320 | A | 3/2002 |

* cited by examiner

*Primary Examiner*—Matthew Luu
*Assistant Examiner*—Lisa M. Solomon
(74) *Attorney, Agent, or Firm*—Canon USA, Inc. IP Div.

(57) ABSTRACT

A spliced ink-jet head including head chips, each of which is capable of discharging inks of two or more colors, and which are spliced in a staggered manner which restrains the occurrence of splice streaks, white streaks caused by deflection at ends or uneven colors attributable to different landing orders of ink droplets in spliced portions of different colors when one-pass recording is carried out. The head chips is arranged such that, in a relationship between two adjoining head chips, at least one discharge port of one head chip and one discharge port of the other head chip for the same color tone ink in end portions overlap on a line in a recording material feeding direction, while discharge ports for different color tone inks do not overlap.

8 Claims, 15 Drawing Sheets

FIG. 9A

| NOZZLE | 1 | 2 | 3 | 4 | 3 | 6 | 7 | | m-4 | m-3 | m-2 | m-1 | m |
|---|---|---|---|---|---|---|---|---|---|---|---|---|---|
| C | 1 | 1 | 1 | 1 | 1 | 1 | 1 | | 1 | 1 | 1 | 1 | 1 |
| M | 0 | 0 | 1 | 1 | 1 | 1 | 1 | | 1 | 1 | 1 | 0 | 0 |

FIG. 9B

| NOZZLE | 1 | 2 | 3 | 4 | 3 | 6 | 7 | | m-4 | m-3 | m-2 | m-1 | m |
|---|---|---|---|---|---|---|---|---|---|---|---|---|---|
| C | 0 | 0 | 1 | 1 | 1 | 1 | 1 | | 1 | 1 | 1 | 0 | 0 |
| M | 1 | 1 | 1 | 1 | 1 | 1 | 1 | | 1 | 1 | 1 | 1 | 1 |

INK-JET HEAD AND INK-JET RECORDING APPARATUS USING THE HEAD

BACKGROUND OF THE INVENTION

1. Field of the Invention

The present invention relates to an ink-jet head and an ink-jet recording apparatus using the head and, more particularly, to an ink-jet head in which rows of discharge ports are provided by disposing a plurality of head chips in a direction orthogonal to a direction in which a recording material is carried, and an ink-jet recording apparatus that uses the head.

2. Description of the Related Art

A recording apparatus used with a printer, a copying machine or the like, or as an output unit for compound electronic equipment or a workstation including a computer, a word processor or the like is adapted to record images, including characters and symbols, on a recording material, such as paper or thin plastic sheets, on the basis of recording information.

A full multi-type ink-jet head is available as a recording head used for such recording apparatuses. In the full multi-type recording head, it has been difficult to machine nozzles with no defect over an extensive range, e.g., over a full width of a recording area (unless otherwise specified, the term "nozzle" may be used as a generic term to mean ink discharge ports, liquid passages in communication with the ink discharge ports, and elements disposed in the liquid passages to generate energy used for discharge). If, for example, a printer for outputting photographic toner images on large-sized paper used as materials at offices or the like were to perform recording at 1200 dpi on a sheet of A3-size paper over a recording width of about 280 mm, then about 14,000 discharge ports would be required to cover the recording width. It is extremely difficult to achieve a manufacturing process that makes it possible to machine every nozzle without any defects for such a large number of discharge ports. Even if it were possible to successfully fabricate the nozzles, the non-defective rate would be low, while the manufacturing cost would be extremely high.

As a solution to the problem described above, a full multi-type ink-jet head has been devised. In this type of ink-jet head, a plurality of relatively inexpensive, short chips, which are used in serial type recording apparatuses, is combined and arranged with high accuracy until a desired length is reached. This is called a "spliced head."

FIG. 17 is a schematic diagram showing a construction example of such an ink-jet head. An ink-jet head IH has two rows of head chips HC numbered in sequence starting with 1 and arranged in a staggered manner. The rows of head chips HC extend in a direction Y in the figure, i.e., the direction orthogonal to or cross the direction in which a recording material is carried. The head chips HC having adjacent numbers are arranged such that they have spliced portions wherein a predetermined number of discharge ports located in end portions overlap each other. Color recording by using the spliced head IH having the configuration described above can be implemented by arranging, in the same chip, the head chips HC that have columns of discharge ports NAC, NAM, NAY, and NABk corresponding to cyan (C), magenta (M), yellow (Y), and black (Bk), respectively, arranged in a direction X in the figure, i.e., the direction in which the recording material is fed, in the staggered manner in a direction orthogonal to or intersectional with the direction in which the recording material is fed.

In every ink-jet head having the construction described above, the spliced portion of each head chip has two discharge ports of all ink colors overlapping at the same location on a line in the recording material feeding direction. Therefore, when an image is formed by discharging the inks onto a recording material, all ink colors overlap in the spliced portion on the line in the recording material feeding direction. As a result, a thickly colored "splicing streak," which extends in the direction in which a recording material P is fed, frequently shows on a formed image.

To solve the aforementioned problem, an ink-jet head having a construction shown in FIG. 18 has been devised (refer to Japanese Patent Laid-Open No. 2000-289233). In a spliced portion in this ink-jet head, the rows of the discharge ports of color inks are disposed in a staggered manner in the Y direction on the same head chip, and the head chips are arranged such that the discharge ports of the same color ink in adjacent head chips are not positioned on a line in the recording material feeding direction.

However, in the construction illustrated in FIG. 18, a problem arises in some cases in that the absence of overlapping discharge ports of the same color ink on the line in the recording material feeding direction between adjacent head chips produces a "splice streak" or "white streak." This is represented by, for example, the "deflection at ends" disclosed in Japanese Patent Laid-Open No. 2002-67320. The deflection at ends is a phenomenon in which, when an image with a high recording duty is recorded at high speed with an arrangement of minute discharge ports, the directions of inks discharged from the discharge ports located on an end are deflected toward the inside of the arrangement of the discharge ports. More specifically, referring to FIG. 18, the directions are deflected in a $Y_R$ direction at an end of a head chip HC (n−1), while they are deflected in a $Y_L$ direction at an end of a head chip HC (n) ("n" being an integer). This means that the landing points of discharged inks do not exactly match the positions of the corresponding discharge ports. Hence, when spliced heads are used, the white streaks are drawn in the recording material feeding direction in the recorded portions that correspond to the spliced portions of adjacent head chips.

Japanese Patent Laid-Open No. H5-57965 has disclosed the following method as a solution to the aforementioned problem.

Referring to FIG. 19, head chips are disposed such that at least two discharge ports of the same ink color overlap on a line in the recording material feeding direction in the spliced portions of the head chip HC (n−1) and the head chip HC (n), and data is decimated so that one of the overlapping discharge ports is selected to perform the recording of a line (the same luster) in the direction in which the recording material P is fed. This makes it possible to reduce to half the recording duty of each discharge port in the spliced portions at ends of the head chips, thus allowing deflection at ends to be controlled in the construction shown in FIG. 19.

However, another problem described below is posed if the construction shown in FIG. 19 in which the discharge ports of the same ink color in adjacent head chips are partly overlapped is actually used. It has been further discovered that the problem arises especially when the head constructed as illustrated in FIG. 19 is used to perform "one-pass" recording. One-pass recording is recording accomplished by one relative scan of an ink-jet head in the same recording area on a recording medium.

Referring now to FIG. 20, the recording material P is fed from a cyan discharge port row NAC of an ink-jet head or the head chip HC toward a black discharge port row NABk (X direction). At this time, since one-pass recording is carried out, ink droplets are shot onto the recording material P always in the order of cyan, magenta, yellow, and black in a non-spliced portion in which the discharge ports of the same color ink are not overlapped on a line in the recording material feeding direction (the X direction). Meanwhile, since the discharge ports of the same color ink are overlapped on the line in the recording material feeding direction in a spliced portion. Thus, although it depends on how data is decimated, a cyan ink dot, for example, is contaminated by an ink dot of another color adhering thereon or the cyan ink dot adheres onto a formed ink dot of another color.

In the case of the ink-jet recording, it has been known that even if ink droplets of two different colors are landed at the same point, the resulting dot undesirably exhibits two different colors to human eyes, depending on the landing order of the ink droplets. Hence, different landing orders result in different color shades between spliced portions and non-spliced portions, causing uneven color in the spliced portions.

SUMMARY OF THE INVENTION

The present invention is directed to an ink-jet head that prevents "splice streaks" caused by discharge ports of different colors overlapping on a line in a recording material feeding direction between adjacent head chips constituting a spliced head, and "white streaks" caused by deflection on ends and uneven color in spliced portions attributable to different landing orders of ink droplets of different colors. The present invention is also directed to an ink-jet recording apparatus using the ink-jet head, and a method of controlling discharge of color inks from the ink-jet head.

In one aspect of the present invention, an ink-jet head includes: at least first and second head chips, each of the first and second head chips including ports arranged at least along first and second rows having end portions, wherein at least one of the first row of ports includes a first discharge port selectively configured to discharge a first color ink, wherein at least one of the second row of ports includes a second discharge port selectively configured to discharge a second color ink, wherein the first and second head chips adjoin each other such that the first and second rows of ports of the first head chip are staggered relative to the first and second rows of ports of the second head chip at their end portions, wherein at the end portions of the first and second head chips, the first discharge port of the first head chip overlaps with the second discharge port of the second head chip, and the second discharge port of the first head chip does not overlap with the first discharge port of the second head chip.

In another aspect, a method of controlling discharge of a plurality of color inks, including first and second color inks, from an inkjet head, including the following steps: providing the inkjet head with at least first and second head chips; providing each of the first and second head chips with ports arranged at least along first and second rows; adjoining the first and second head chips such that the first and second rows of ports of the first head chip are staggered relative to the first and second rows of ports of the second head chip at their end portions; and selecting, from the first row of ports of the first and second head chips, first discharge ports to discharge the first color ink, and selecting, from the second row of ports of the first and second head chips, second discharge ports to discharge the second color ink, such that at the end portions of the first and second head chips, the first discharge port of the first head chip overlaps with the second discharge port of the second head chip, and the second discharge port of the first head chip does not overlap with the first discharge port of the second head chip.

Further features and advantages of the present invention will become apparent from the following description of the embodiments with reference to the attached drawings.

BRIEF DESCRIPTION OF THE DRAWINGS

FIG. 9A and FIG. 9B are schematic diagrams illustrating the data for deciding which nozzles in a head chip are to be used.

DESCRIPTION OF THE EMBODIMENTS

The following will explain the present invention in detail with reference to the accompanying drawings.

First Embodiment

Figure 1:
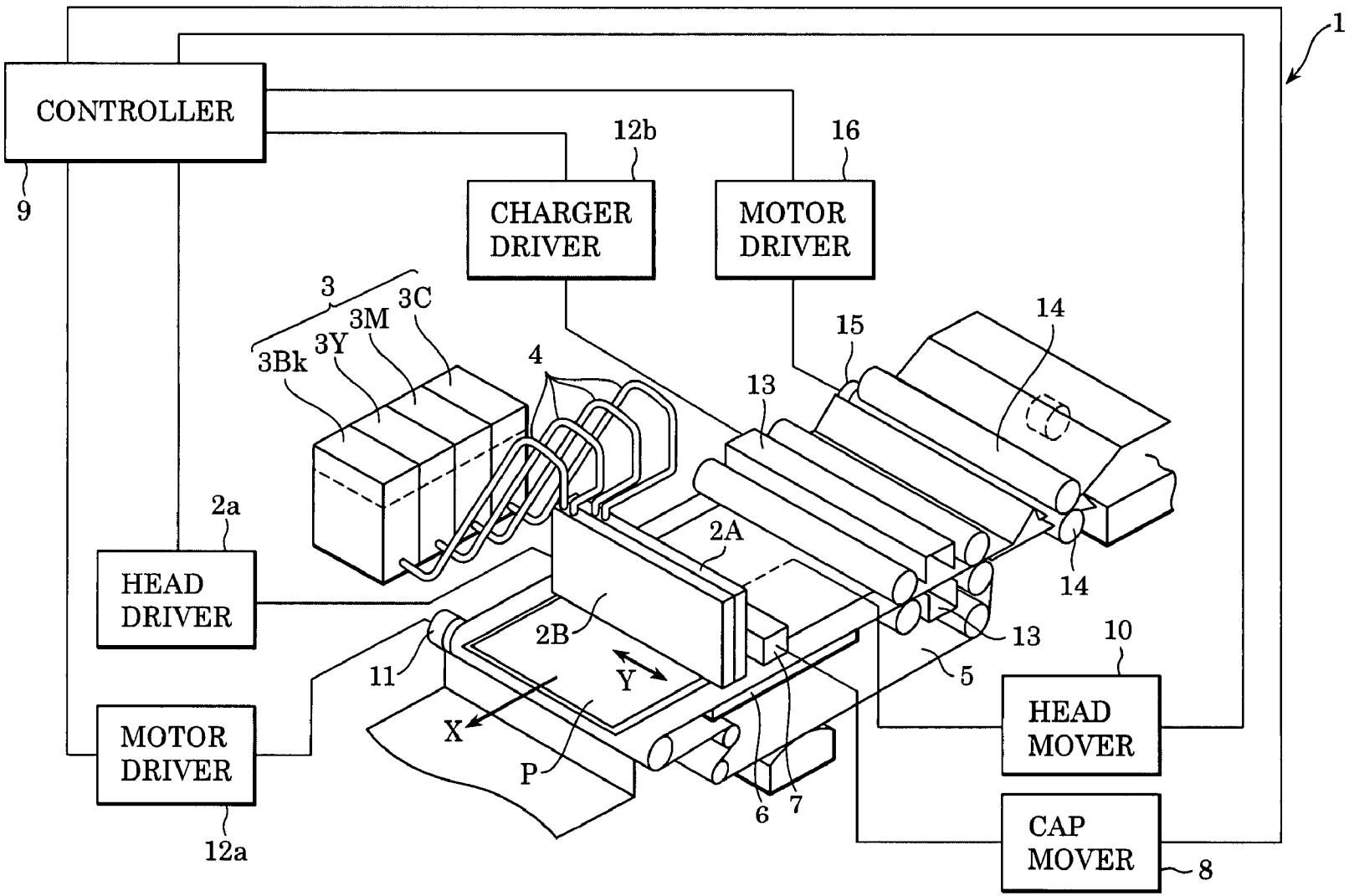
FIG. 1 is a schematic perspective view of an ink-jet recording apparatus according to a first embodiment of the present invention.

FIG. 1 is a schematic perspective view of an ink-jet recording apparatus 1 according to a first embodiment of the present invention.

The ink-jet recording apparatus 1 according to the present embodiment can be, for example, a full-line type color ink-jet recording apparatus having lengthy ink-jet heads 2A and 2B arranged side by side that extend in a Y direction orthogonal to or intersecting with an X direction in which a recording material P is fed. The ink-jet head 2A includes head chips, each having a row of cyan ink discharge ports and a row of magenta ink discharge ports arranged over a predetermined area in a direction orthogonal to the direction in which the recording material P is fed. The head chips are disposed in a staggered manner in a direction orthogonal to the feeding direction of the recording material P such that recording covering the full width of the recording material P in the Y direction can be accomplished. This arrangement constitutes a spliced head that permits recording over the width of the recording material P in the Y direction. The ink-jet head 2B for yellow ink and black ink has the same construction as the ink-jet head 2A.

The ink-jet head 2A receives ink from an ink tank 3C storing a cyan ink and an ink tank 3M storing a magenta ink through connection tubes 4. Similarly, the ink-jet head 2B receives inks from an ink tank 3Y storing a yellow ink and an ink tank 3Bk storing a black ink through connection tubes 4. In each ink-jet head, an ink supply passage is distributed to each head chip.

In the following description, the ink-jet heads 2A and 2B will be generically referred to as an ink-jet head 2 unless it is necessary to distinguish them. Similarly, the four ink tanks, 3Y, 3M, 3C, and 3Bk will also be generically referred to as an ink tank 3 unless it is necessary to distinguish them.

The ink-jet heads 2A and 2B can be moved up/down (toward or away from a recording material) in the figure by a head mover 10 controlled by a controller 9. Provided on the sides of the ink-jet heads 2A and 2B are head caps 7 for resetting the ink-jet heads by ejecting, from discharge ports, thickened ink or the like in ink passages in communication with the discharge ports before starting an operation for recording on the recording material P. A conveying belt 5 for feeding the recording material P is installed on a drive roller connected to a belt drive motor 11, and its operation is switched by a motor driver 12*a* connected to the controller 9. As an additional device, a charger 13 may be provided on an upstream side of the conveying belt 5 to charge the conveying belt 5 so as to bring the recording material P in close contact with the conveying belt 5. The charger 13 is turned ON/OFF by a charger driver 12*b* connected to the controller 9. A feeding motor 15 is connected to a pair of feeding rollers 14 to drivably rotate the rollers. The pair of feeding rollers 14 conveys the recording material P onto the conveying belt 5. The operation of the feeding motor 15 is switched by a motor driver 16 connected to the controller 9. Thus, to record on the recording material P, the charger 13 is actuated and the conveying belt 5 is driven at the same time, the recording material P is placed on the conveying belt 5 by the pair of feeding rollers 14 and then the ink-jet heads 2 record a color image onto the recording material P. A head driver 2*a* drives a heater, which will be discussed hereinafter, by ON/OFF signals.

A description will now be given of a construction of a head chip applied to the ink-jet head used in the present embodiment, and a basic ink discharging operation.

Figure 2:
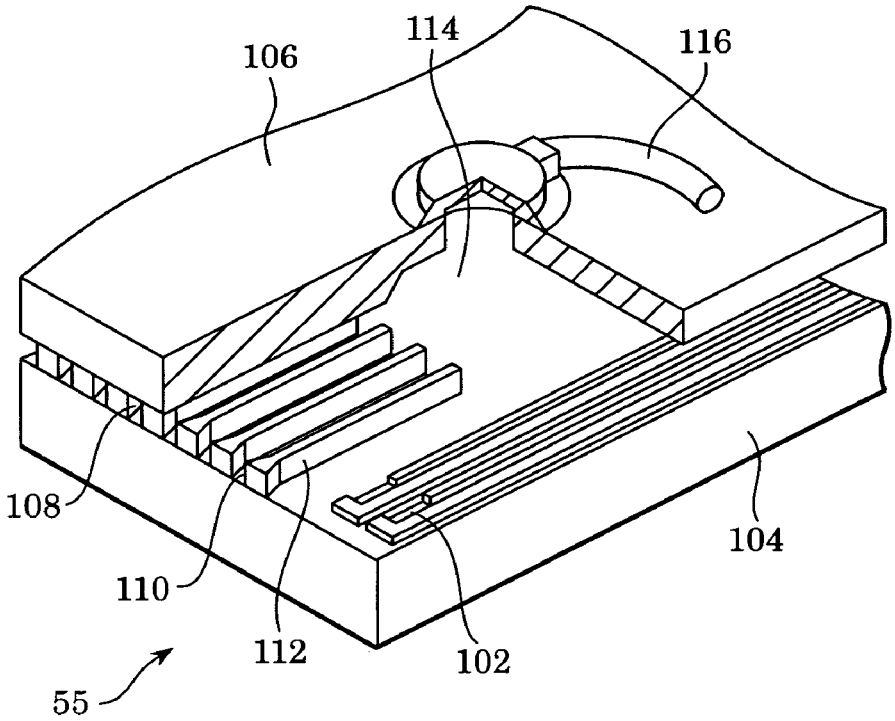
FIG. 2 is a schematic perspective view of an essential section of a head chip.

FIG. 2 shows a construction example of a head chip 55.

The head chip 55 includes a substrate, namely, a heater board, 104 having a plurality of heaters 102 for generating heat energy for causing ink to develop film boiling as the energy to be used for discharging ink, and a top plate 106 joined over the heater board 104. The top plate 106 has a plurality of discharge ports 108 and grooves that provide tunnel-shaped liquid passages 110 that extend at the rear of the discharge ports 108 and are in communication with the discharge ports 108. Adjoining liquid passages 110 are isolated from each other by partitions 112. Every liquid passage 110 is provided with a heater 102 and connected to a liquid chamber 114 at an opposite end from the discharge port. The liquid chamber 114 receives ink from the ink tank 3 through an ink supply port 116. The ink is then supplied from the liquid chamber 114 to the liquid passages 110. The heater board 104 and the top plate 106 are positioned and assembled so that the heaters 102 are properly positioned in relation to the liquid passages 110, thus making up the head chip. In the assembled head chip, as shown in FIG. 2, supplying a predetermined drive pulse to the heater 102 triggers film boiling of the ink on the heater 102, producing an air bubble. The volume of the air bubble increases, pushing the ink out of the discharge port 108. Thus, the ink is discharged.

FIG. 2 shows the construction using the heaters having their main planes oriented in a direction substantially parallel to ink discharging directions. Head chips or ink-jet heads having this construction are referred to as an edge-shooter type.

Figure 3:
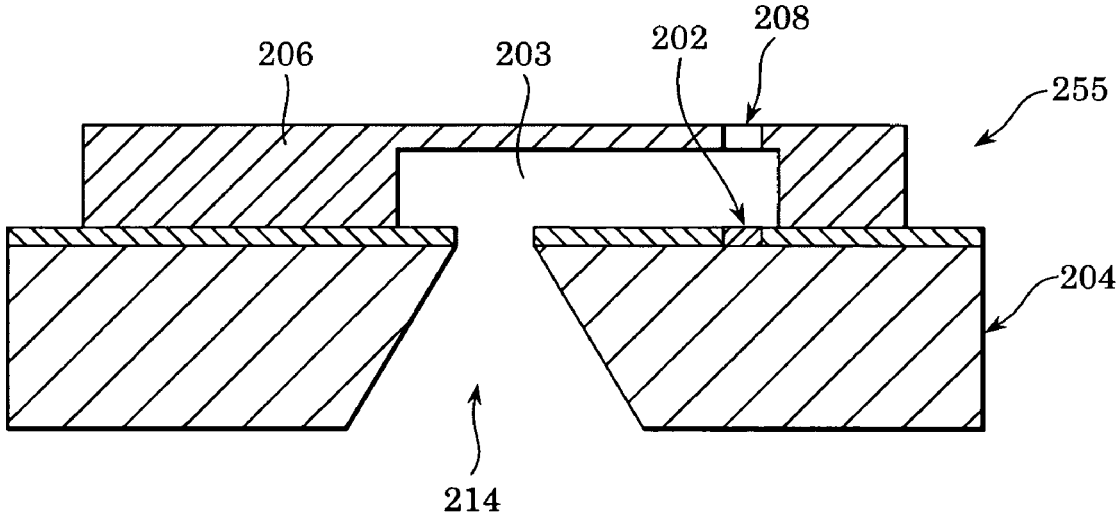
FIG. 3 is a schematic perspective view of another essential section of the head chip.

FIG. 3 shows a construction using heaters having their main planes oriented in a direction substantially perpendicular to the ink discharging directions. Head chips or ink-jet heads having this construction are referred to as a side-shooter type.

In this construction, a heater 202 is disposed at a position opposing a discharge port 208 arranged in a direction perpendicular to the drawing. An electrode wire for supplying power to the heater 202 is formed on the surface of a substrate made of a silicon material or the like to constitute a heater board 204. Joined to the heater board 204 is a discharge port member 206 that has the discharging port 208 and an ink passage 203 in communication with the discharge port 208. Furthermore, an ink supply passage 214 is formed in the heater board 204 to supply ink to the ink passage 203.

The head chip can be obtained by properly positioning and assembling the heater board 204 and the discharge port member 206. Supplying a predetermined drive pulse to the heater 202 in the assembly illustrated in FIG. 3 triggers film boiling of the ink on the heater 202, producing an air bubble. The volume of the air bubble increases, pushing the ink out of the discharge port 208. Thus, the ink is discharged.

Figure 4A:
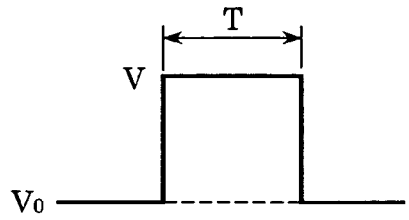
FIG. 4A and FIG. 4B are waveform diagrams showing two example pulses for driving a heater.
Figure 4B:
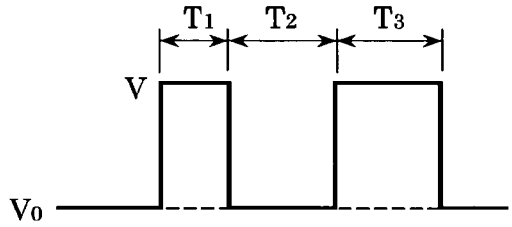

The drive pulse or the heat pulse supplied to the heater may have a waveform shown in FIG. 4A or 4B. The waveform shown in FIG. 4A is a simple single-pulse waveform having a voltage V over a period (pulse width) T. FIG. 4B illustrates a double-pulse waveform, wherein T1 denotes a pulse width of a first pulse (pre-pulse) of divided plural (two) pulses, T2 denotes an interval time (pause time), and T3 denotes a pulse width of a second pulse (main pulse). In the waveform shown in FIG. 4B, properly modulating the divided pulse or the interval time allows the discharge amount to be changed. These waveforms can be selected according to requirements.

Figure 5:
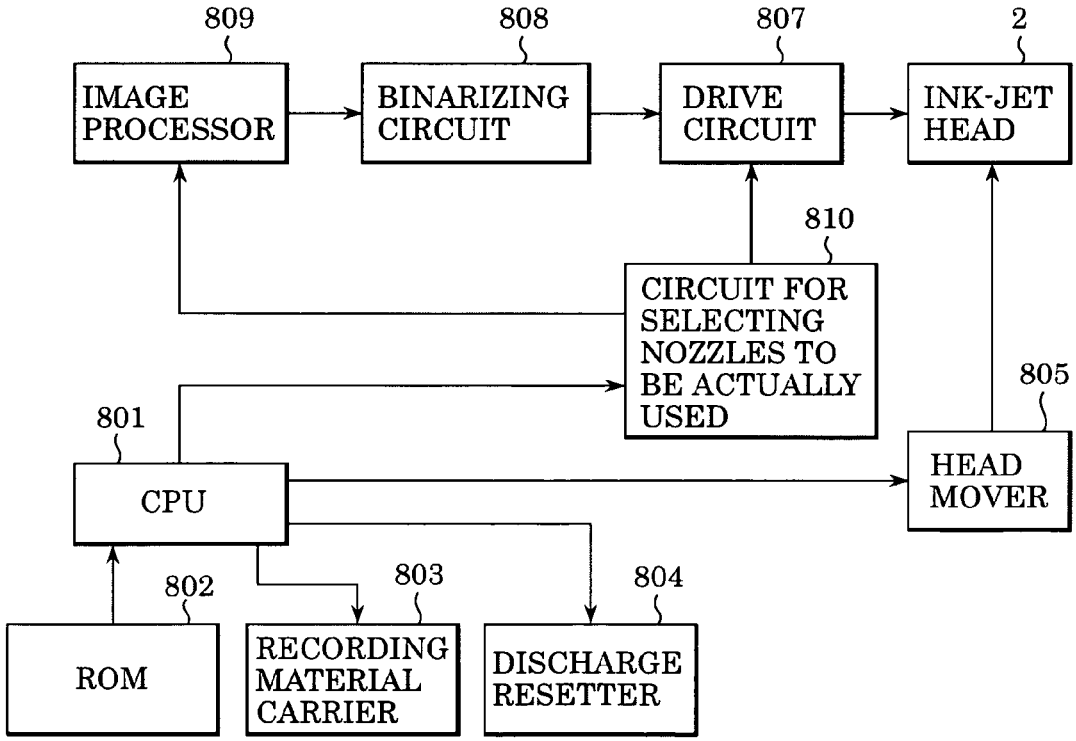
FIG. 5 is a block diagram of a control system of the ink-jet recording apparatus of the first embodiment of the present invention.

FIG. 5 is a block diagram of a control system of an ink-jet recording apparatus according to the present embodiment. In the figure, a CPU 801 corresponding to the controller shown in FIG. 1 controls the entire system, and a ROM 802 stores programs for system control executed by the CPU 801 and other fixed data. A recording material carrier 803 for conveying a recording material, such as paper or an OHP film, includes mainly the belt drive motor 11, the motor driver 12*a*, the feeding motor 15, and the motor driver 16. A discharge resetter 804 for resetting a head includes the head cap 7 and a cap mover 8. A head mover 805 includes a carrier having the ink-jet head mounted thereon and a head moving means for moving the carrier, as required.

A drive circuit 807 corresponding to the head driver 2*a* drivably controls the heaters of the ink-jet head 2. A binarizing circuit 808 for converting an image to be recorded into discharge data primarily performs halftoning. An image processor 809 performs color separation according to an ink color of the ink-jet head 2 when an image to be recorded, e.g., an image received from a host apparatus, such as a computer (not shown), is a color image.

A circuit 810 selects nozzles to be actually used for discharging according to a head chip or an ink-jet head constructed as described hereinafter. More specifically, the circuit 810 for selecting nozzles to be actually used properly decides on nozzles to be actually used from among physically existing nozzles, namely, ink discharging ports, and transfers required recording data on the nozzles to be actually used to the drive circuit 807. Thus, the present embodiment is an example wherein nozzles to be actually used are selected by electrical signals.

Figure 6:
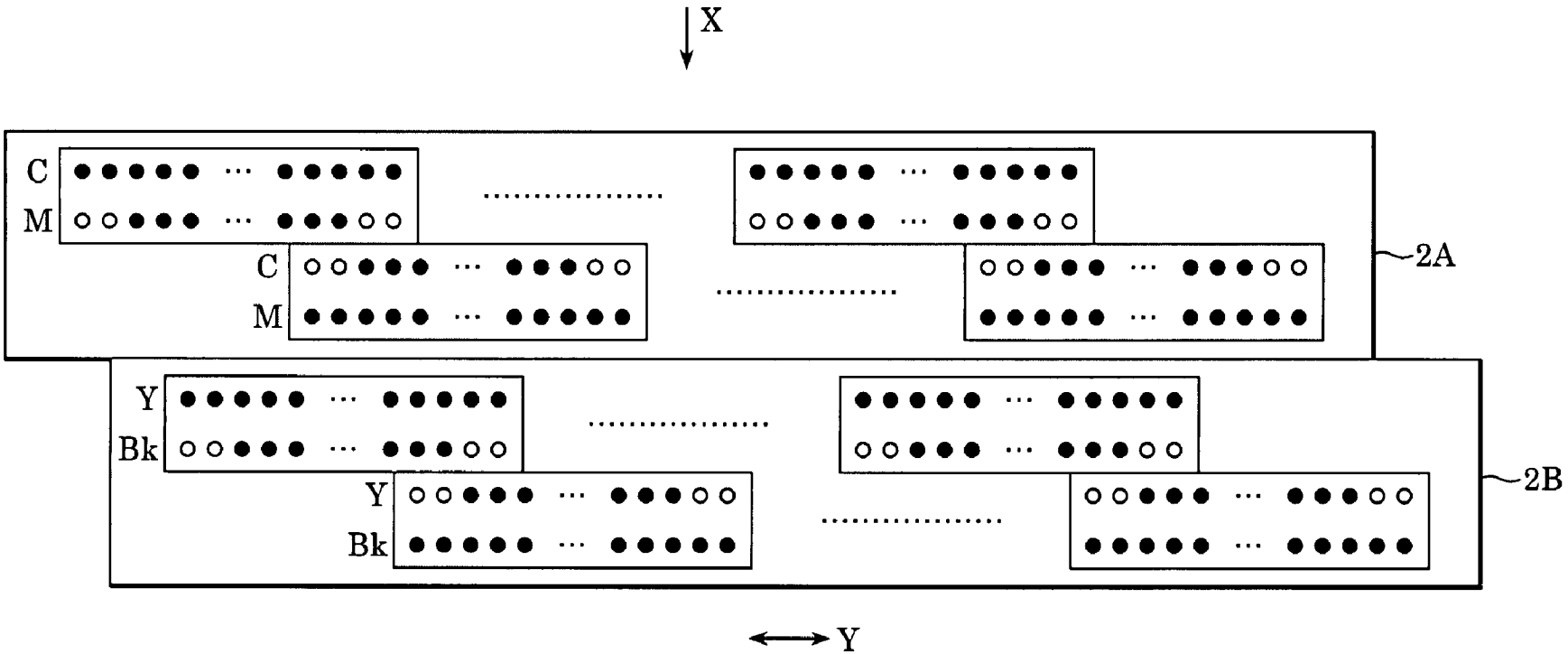
FIG. 6 is a schematic diagram of two ink-jet heads according to the first embodiment of the present invention.

FIG. 6 shows a construction example of the ink-jet heads 2A and 2B of the present embodiment, and schematically illustrates the surfaces of the heads on which discharge ports are disposed. The ink-jet head 2A in this example is a spliced head type having head chips arranged in a staggered manner, each head chip including a row of cyan ink discharging ports and a row of magenta ink discharging ports that are disposed in a predetermined area in a direction orthogonal to the direction in which the recording material P is fed. The ink-jet head 2B has the same configuration as that of the ink-jet head 2A except that it has rows of yellow and black ink discharging ports. The ink-jet heads 2A and 2B disposed side by side permit recording of color images using four colors. The discharge ports indicated by black dots are the ones actually used, while the discharge ports indicated by white dots are the ones not used for actual recording. In a spliced portion of adjacent head chips, two or more discharge ports in a row of discharge ports in the Y direction at ends are overlapped on a line in the recording material feeding direction or the X direction, whereas a spliced portion of the ink-jet head 2A and a spliced portion of the ink-jet head 2B are not overlapped in the X direction. With this arrangement, the discharge port overlapping portions of spliced portions of all colors do not match, thus preventing splicing streaks from being produced in the direction in which the recording material P is fed.

The present embodiment prevents white streaks and uneven colors in spliced portions in head chips in each head. For this purpose, nozzles to be actually used are properly selected in each head. This will be explained, taking the ink-jet head 2A, as an example.

Figure 7:
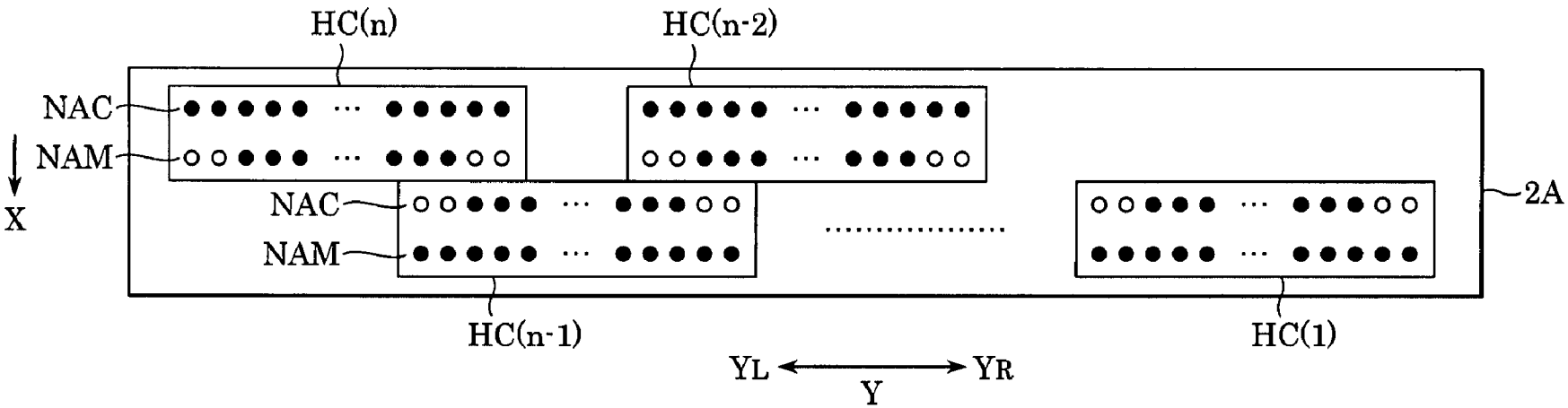
FIG. 7 is a schematic diagram of one of the ink-jet heads shown in FIG. 6.
Figure 8:
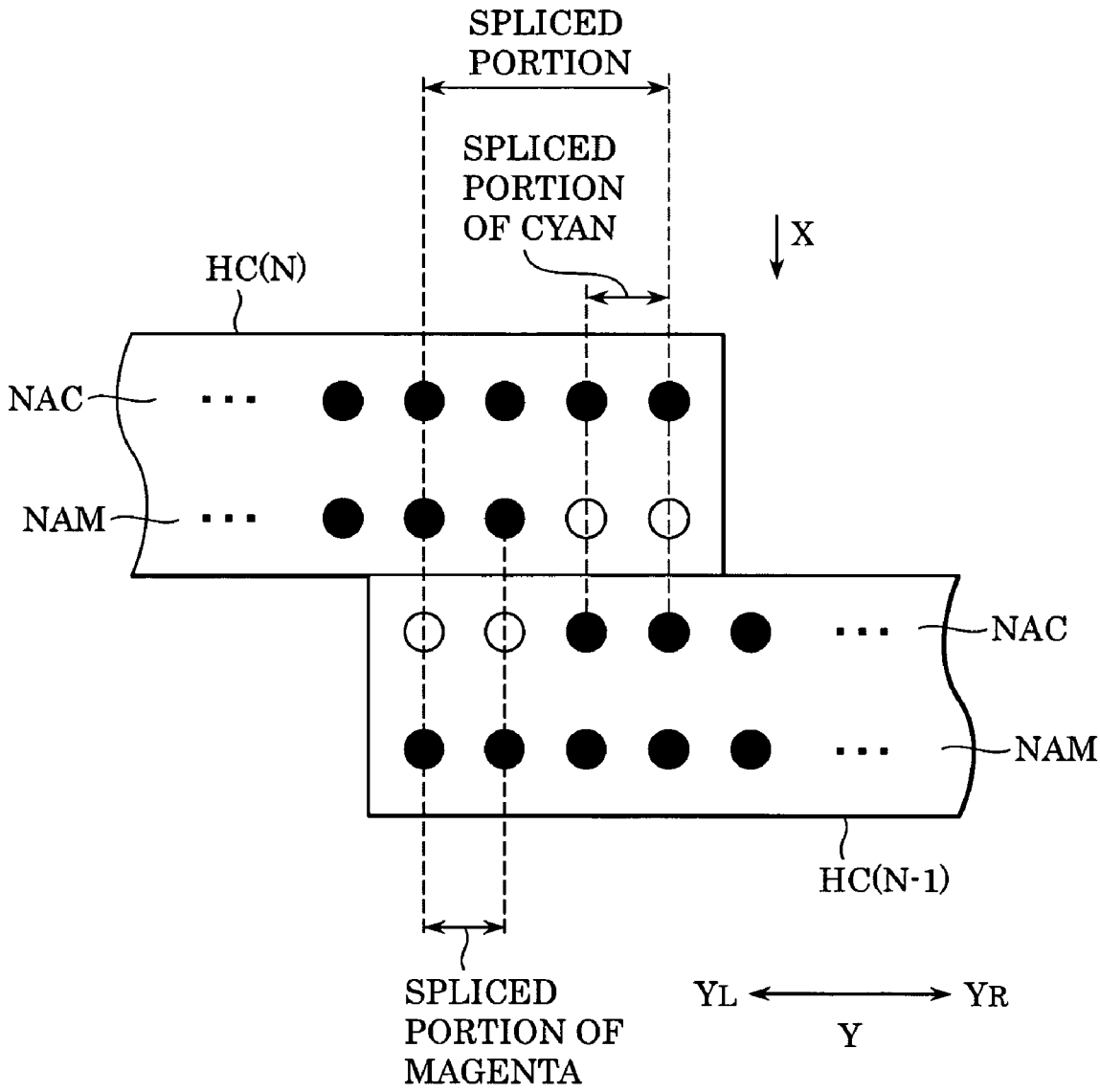
FIG. 8 is a schematic enlarged view of a spliced portion of the head chip constituting the ink-jet head shown in FIG. 7.

FIG. 7 shows the arrangement of head chips and discharge ports in the ink-jet head 2A. FIG. 8 is an enlarged view of a spliced portion of the head chips. FIG. 9A and FIG. 9B are explanatory diagrams showing the details of data for selecting nozzles to be actually used.

In the following description, the X direction refers to the direction in which a recording material is fed. In a construction that allows advantages of the present invention to be achieved, the X direction is defined as the direction in which an ink-jet head and a recording material relatively move in a recording mode during which ink is discharged. In other words, the X direction is the direction in which a recording material is fed in the case of an apparatus of the "full-line" recording type, while the X direction is an ink-jet head scanning direction in an apparatus of the "serial" recording type. The Y direction is a direction intersecting the X direction; however, it is substantially the direction orthogonal to the X direction.

Referring to FIG. 7 and FIG. 8, the white dots denote unused nozzles and the black dots denote actually used nozzles, and the nozzles for four discharge ports in relation to the Y direction are apparently overlapped on the same line in the X direction. However, regarding a cyan discharge port row NAC of a head chip HC (n−1), two discharge ports at the end in a $Y_L$ direction are not used, and these discharge ports are associated with third and fourth discharge ports (actually used nozzles) from the end in a $Y_R$ direction of the cyan discharge port row NAC of a head chip HC (n), and positioned on lines in the X direction, which is the recording material feeding direction. Regarding a magenta discharge port row NAM of a head chip HC (n), two discharge ports at the end in the $Y_R$ direction are not used, and these discharge ports are associated with third and fourth discharge ports (actually used nozzles) from the end in a $Y_L$ direction of the magenta discharge port row NAM of a head chip HC (n−1), and positioned on lines in the X direction, which is the recording material feeding direction. This means that, two discharge ports of actually used nozzles of the same color overlap in the X direction in a spliced portion of head chips, whereas actually used nozzles do not overlap in the X direction between adjoining discharge port rows of different colors.

Regarding the cyan discharge port row NAC of the head chip HC (n), the two discharge ports at the end in the $Y_R$ direction in the figure are nozzles to be actually used. The discharge data for the two discharge ports is to be properly decimated and allocated to the third and fourth discharge ports (actually used nozzles) from the end in the $Y_L$ direction of the cyan discharge port row NAC of the head chip HC (n−1). Similarly, regarding the magenta discharge port row NAM of the head chip HC (n−1), the two discharge ports at the end in the $Y_L$ direction belong to the nozzles to be actually used. The discharge data for the two discharge ports is to be properly decimated and allocated to the third and fourth discharge ports (actually used nozzles) from the end in the $Y_L$ direction of the magenta discharge port row NAM of the head chip HC (n).

Allocating the discharge data as described above allows the recording duty in each head chip end portion to be reduced, thus making it possible to prevent white streaks caused by deflection at an end from being produced.

To overlap ink dots of different colors, while a recording material is being fed in the X direction in the figure, two discharge ports at the end in the $Y_R$ direction of the discharge port row NAC of the head chip HC (n) or the third and fourth discharge ports from the end in the $Y_L$ direction of the discharge port row NAC of the head chip HC (n−1) discharge ink first, and then the third and fourth discharge ports from the end in the $Y_L$ direction of the discharge port row NAM of the head chip HC (n−1) discharge ink in each head chip end portion. The third and fourth discharge ports from the end in the $Y_R$ direction of the discharge port row NAM of the head chip HC (n) discharge ink first, and then the third and fourth discharge ports from the end in the $Y_R$ direction of the discharge port row NAM of the head chip HC (n) or two discharge ports at the end in the $Y_L$ direction of the discharge port row NAM of the head chip HC (n−1) discharge ink.

This means that, in an end portion of each head chip, ink droplets always land in the order of cyan and magenta. Therefore, even when the data is distributed as described above, changes in color shade in spliced portions can be restrained.

Referring to FIG. 9A and FIG. 9B, a procedure for selecting nozzles to be actually used and nozzles not to be used from among physical discharge ports or nozzle rows will be described.

FIGS. 9A and 9B are explanatory diagrams illustrating the details of data for selecting nozzles to be actually used for an arbitrary head chip HC (n) for the cyan and magenta and the head chip HC (n−1) to be spliced. It is assumed that each head chip has an m number of nozzles physically arranged, the nozzles being number from 1 through m (m being an integer).

In the tables, "1" corresponds to data indicating "actually used" and "0" corresponds to data indicating "not used." In the setting shown in FIG. 9A, all nozzles numbered 1 through m are all set to be actually used in the cyan nozzle row NAC. For the magenta nozzle row NAM, the nozzles numbered 3 through m-2 are set to be actually used, while a total of four nozzles, two nozzles at each end are set not to be used for recording although the nozzles actually exist and have an ink discharging capability. In the setting shown in FIG. 9B, the nozzles to be actually used are reversed for cyan and magenta from those shown in FIG. 9A.

The aforementioned selection data can be stored as fixed data in, for example, the ROM 802, or it may alternatively be set in a RAM or EEPROM, as appropriate, according to the construction of a head.

Figure 10:
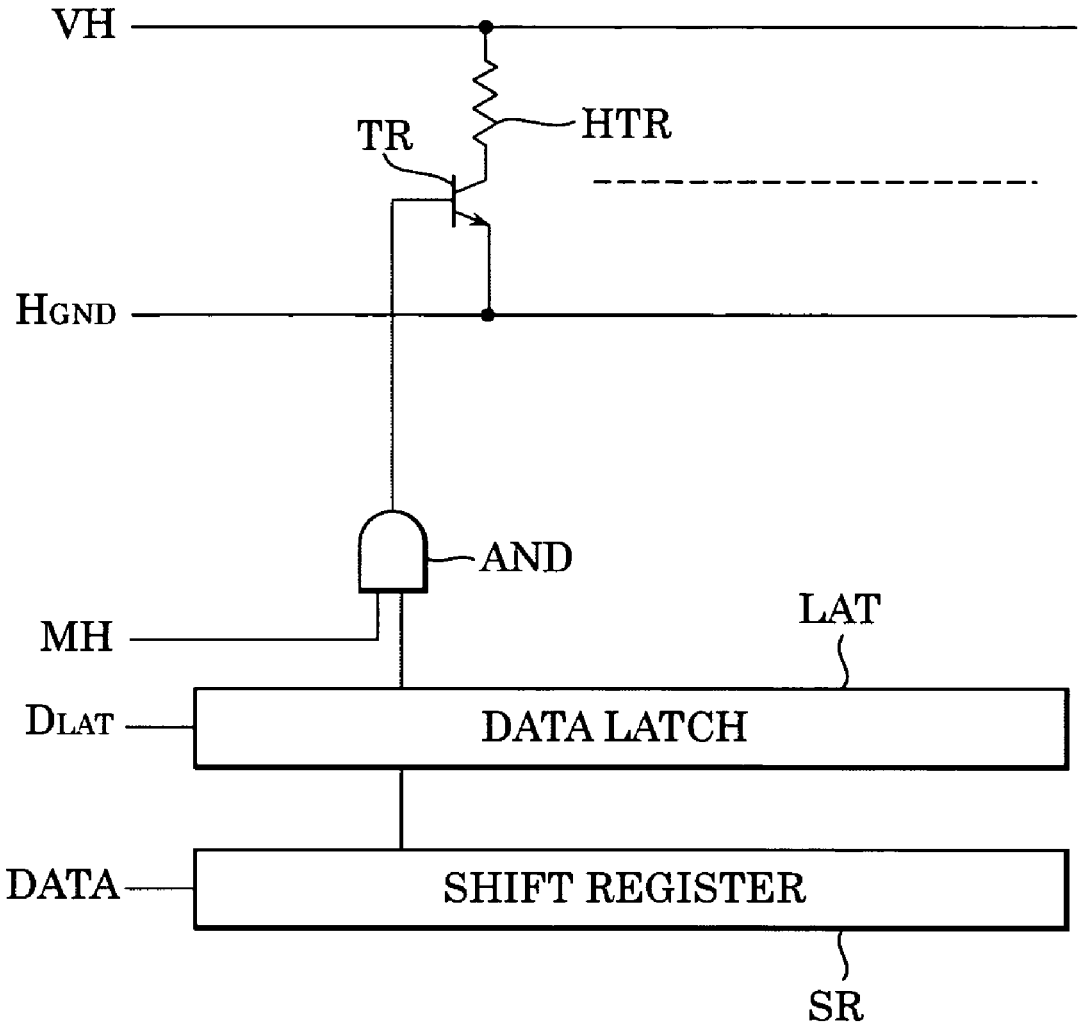
FIG. 10 is a block diagram of a circuit for driving the heater.

FIG. 10 shows an example circuit configuration for independently controlling each nozzle heater by using the data for selecting nozzles to be actually used. Specifically, the circuit can be built in a heater board in a semiconductor manufacturing process.

Referring to FIG. 10, a signal line VH is a power line of an ink-jet head connected to one terminal of a heater HTR, and a signal line HGND is a ground line connected to the other terminal of the heater HTR through the intermediary of a transistor TR for switching ON/OFF. A signal line MH is a signal line of heat pulses and connected to one input end of an AND gate, AND. A signal line DATA is a data line for serially transferring the recording data that specifies discharge or no discharge for each nozzle to a shift register SR. A signal line DLAT is a control line for latching recording data assigned in the shift register SR in association with the nozzles in a latching circuit LAT at appropriate timings. The outputs, namely, heater ON/OFF signals, are connected to the other input end of the AND gate, AND.

When the shift register has received the data for all nozzles, a DLAT signal is generated to latch data, and a heat pulse period is turned valid by the AND gate, AND. A heater ON signal turns the transistor TR on to energize the heater HTR, and ink is heated and bubbled so as to be discharged through a discharge port.

In this construction, sending the data specifying the nozzles to be actually used by the circuit 810 to an image processor 809 allows the recording data to be allocated beforehand to corresponding nozzles. In the circuit configuration shown in FIG. 10, signal lines for selecting nozzles to be actually used and the AND circuit for acquiring a logical product of a selection signal and the aforesaid ON/OFF signal may be added to the aforesaid circuit shown in FIG. 10.

The above description has referred to the construction of the head 2A for cyan and magenta inks. The same construction applies to the head 2B for yellow and black inks.

Another Embodiment

The present invention is not limited to the embodiment described above, and it may apply to various other constructions, some of which will be exemplified below.

For example, the first embodiment uses the ink-jet head 2A having the cyan ink and magenta ink discharge port rows disposed on the same chip and the ink-jet head 2B having the yellow ink and black ink discharge port rows disposed on the same chip. Alternatively, an ink-jet head having the discharge port rows for the four color inks on the same chip may be used.

Figure 11:
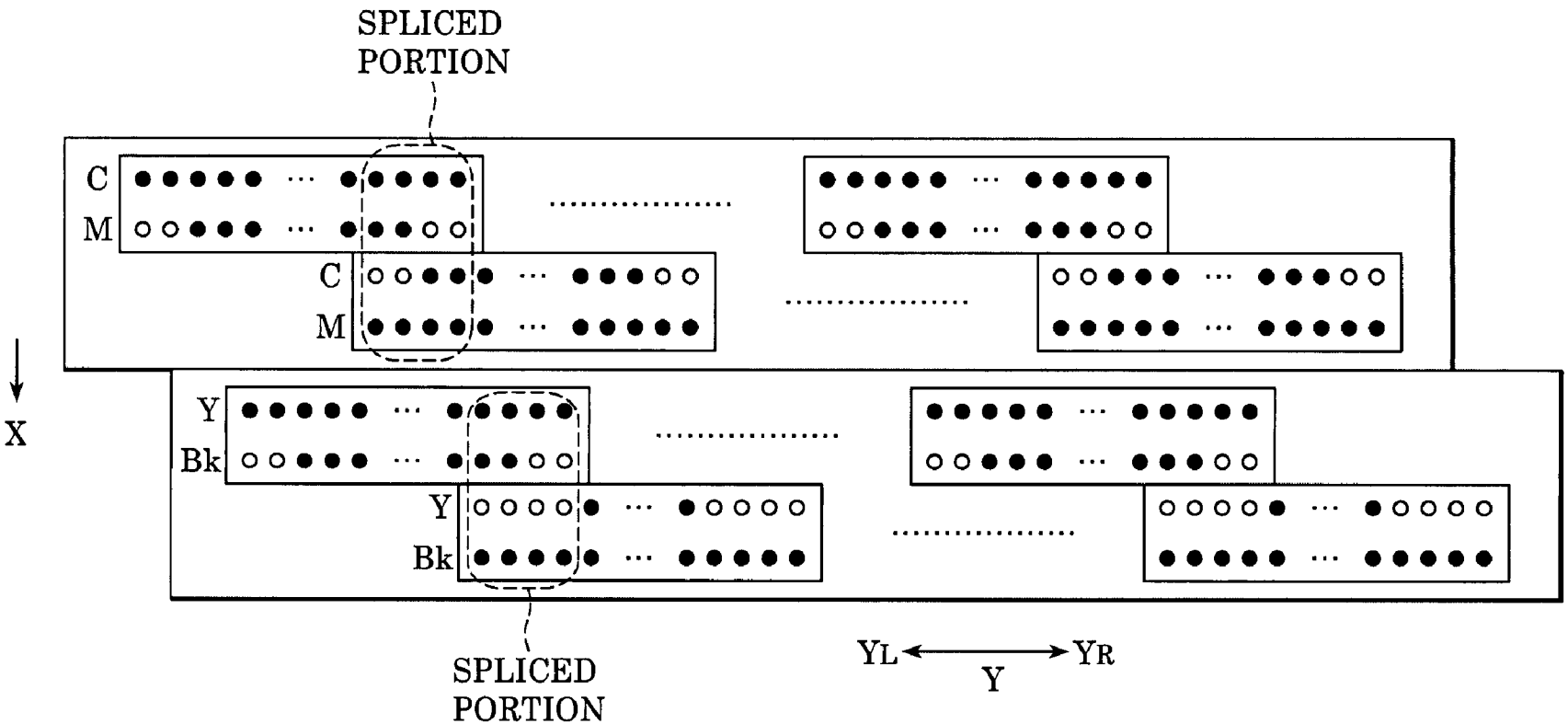
FIG. 11 is a schematic diagram of an ink-jet head according to another embodiment of the present invention.

FIG. 11 shows a construction example wherein two ink-jet heads are used, as in the first embodiment, but only the yellow ink discharge ports are not overlapped on lines in the recording material feeding direction (the X direction) in a spliced portion.

Figure 12:
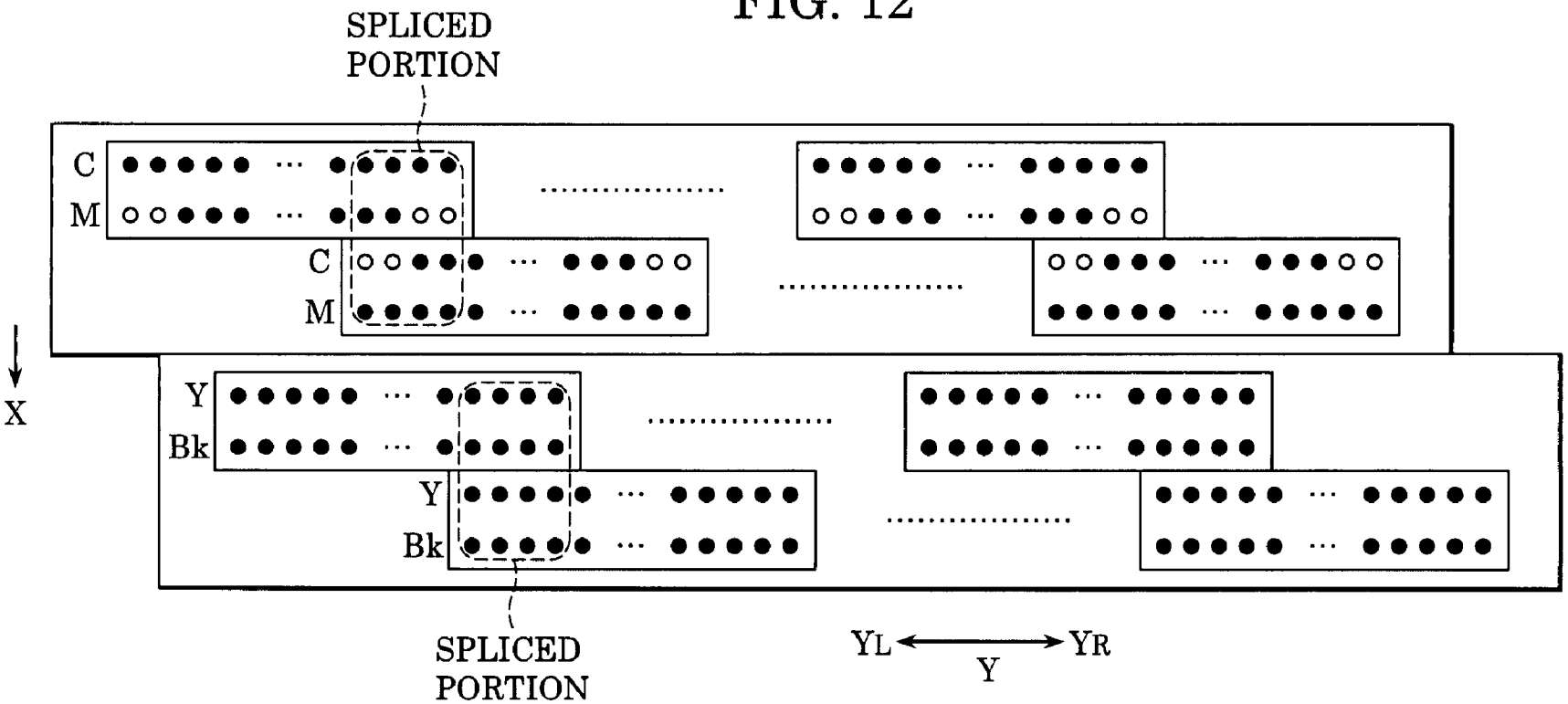
FIG. 12 is a schematic diagram of an ink-jet head according to another embodiment of the present invention.

FIG. 12 shows a construction example wherein two ink-jet heads are used, as in the first embodiment, but the black ink discharge port rows are overlapped on lines in the recording material feeding direction (the X direction) in a spliced portion. This layout takes into account the optical density characteristics of ink. More specifically, the construction shown in FIG. 11, for example, takes advantage of the fact that yellow has a lower optical density, so that yellow streaks or color irregularities are usually less recognizable to human eyes. Obviously, however, if a case where a secondary or tertiary color using yellow is considered, then the discharge ports are not overlapped with the discharge ports of other colors, including yellow, on lines in the X direction, while at least one or more discharge ports for the same color ink are overlapped on lines in the X direction in a spliced portion.

Figure 13:
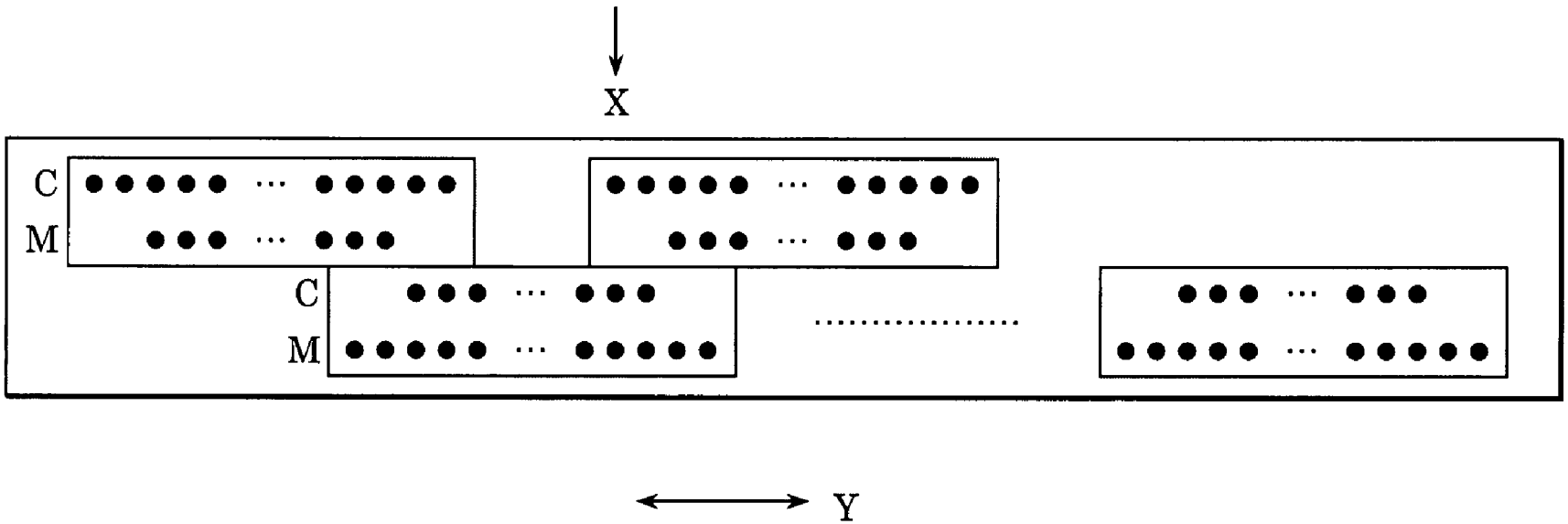
FIG. 13 is a schematic diagram of an ink-jet head according to another embodiment of the present invention.

Furthermore, in the first embodiment, the physically existing nozzles have been selected to be used or not. As an alternative, nozzles not to be used may be removed, that is, the section including the nozzles not to be used is not formed from the beginning. For example, as illustrated in FIG. 13, nozzles not to be used in the cyan and magenta discharge port rows are removed beforehand. This can be implemented by skipping the formation of those nozzles on chips.

Figure 14:
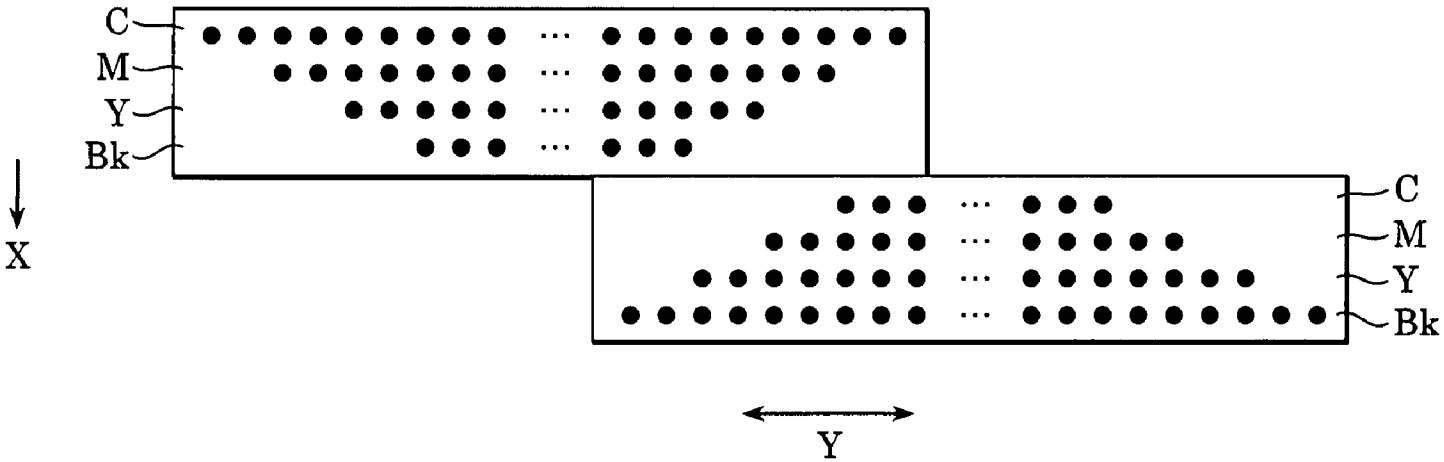
FIG. 14 is a schematic diagram of an essential section of an ink-jet head according to another embodiment of the present invention.

As another alternative construction shown in FIG. 14, a head chip having discharge port rows for the four colors are mounted on the same chip without any nozzles, which are not to be used. Two head chips having such a construction are prepared and spliced in a staggered manner in the Y direction to form a lengthy head, as shown in FIG. 14. The two spliced head chips are shown in FIG. 14; however, the number of head chips is not limited to two. A required number of head chips may be used.

In the construction according to the first embodiment wherein actually existing nozzles themselves are not used, it may be possible that, depending on the number of nozzles not actually used, ink in the unused nozzles is concentrated due to evaporation or the like of an ink solvent and the ink with the higher concentration reaches the ink in an adjoining nozzle actually being used, undesirably leading to a higher concentration of the ink in the adjoining nozzle. On the other hand, the first embodiment is advantageous in that the number of discharge ports to be overlapped on lines in the recording material feeding direction can be freely set. The problem in that the ink concentration increases in the first embodiment can be solved by performing a resetting operation, such as a preliminary discharge, on all nozzles including unused nozzles so as to eject concentrated ink prior to the start of recording.

In other words, whether the construction in which only the nozzles to be actually used are selected from a group of physically existing nozzles or the construction in which the nozzles not to be used are removed beforehand should be adopted is decided by selecting a type of head that provides advantages suited to desired conditions, such as the construction of an apparatus using an ink-jet head and the type of control thereof.

In the embodiments described above, the nozzles of each color in a head chip are horizontally aligned in a single row. Alternatively, however, a plurality of rows of nozzles may be provided for each color.

Figure 15:
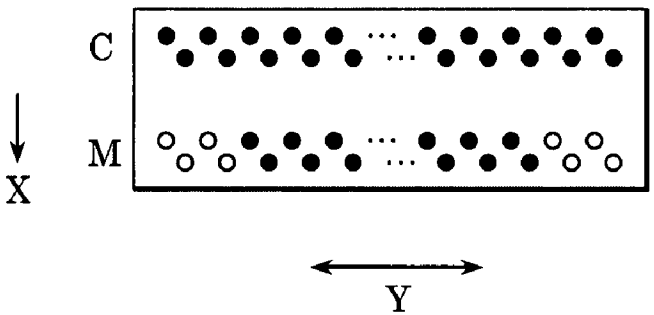
FIG. 15 is a schematic diagram of a head chip of an ink-jet head according to another embodiment of the present invention.
Figure 16:
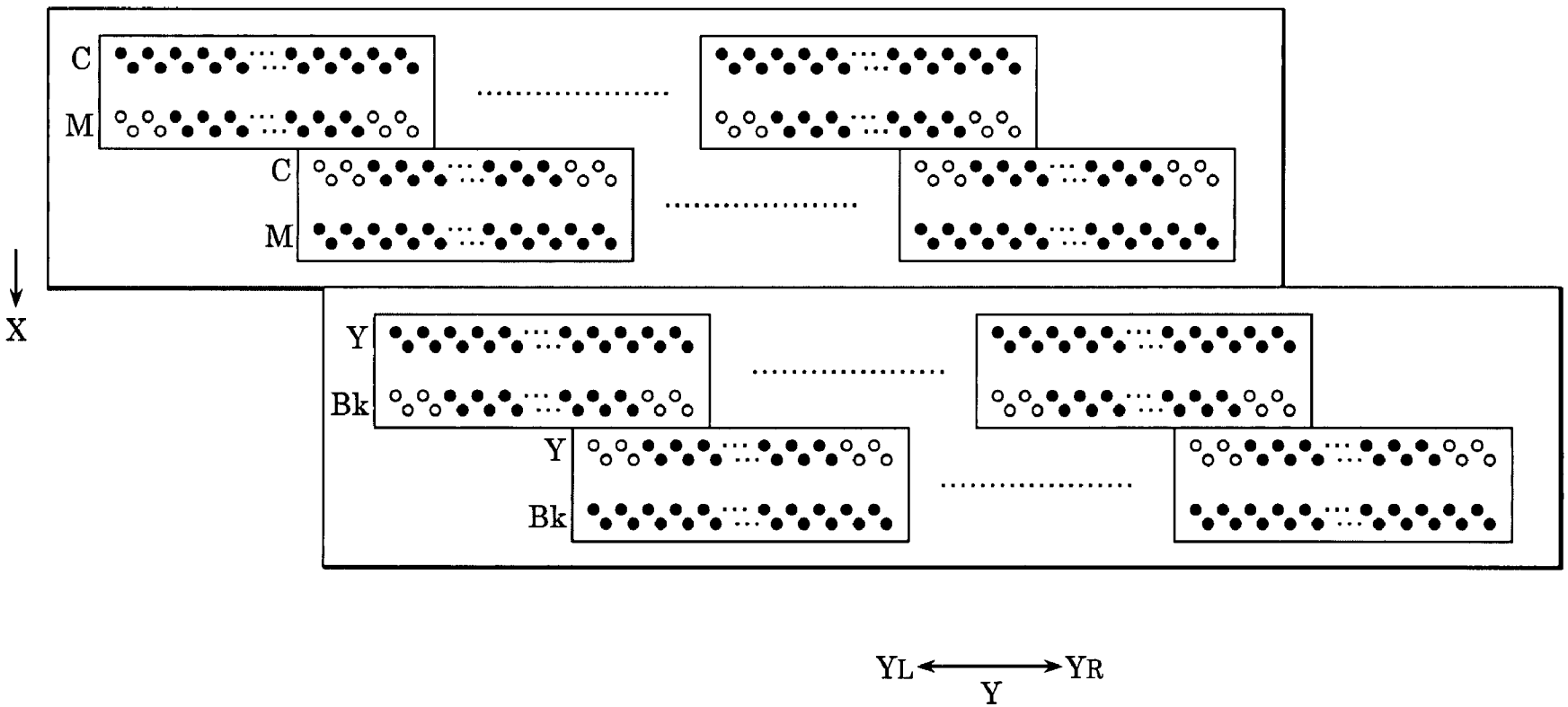
FIG. 16 is a schematic diagram showing an ink-jet head which is constructed by splicing the head chip shown in FIG. 15 and which is applied to a further embodiment of the present invention.
Figure 17:
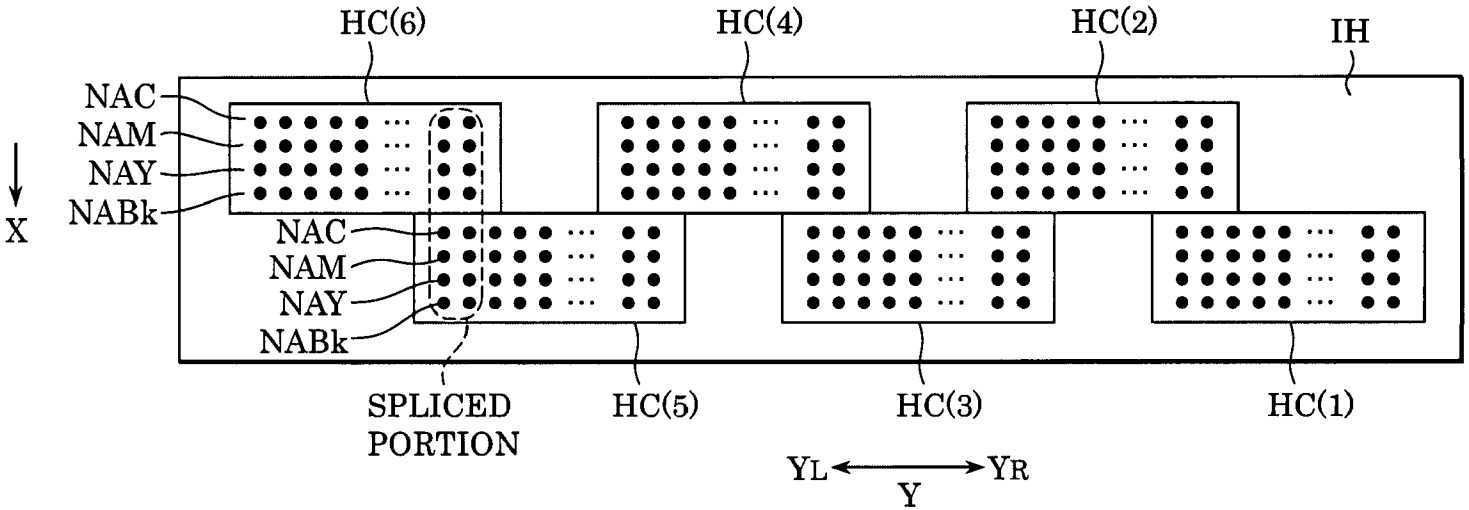
FIG. 17 PRIOR ART
FIG. 17 is a schematic diagram illustrating a lengthy ink-jet head of a conventional example constructed by splicing short head chips for a plurality of colors.
Figure 18:
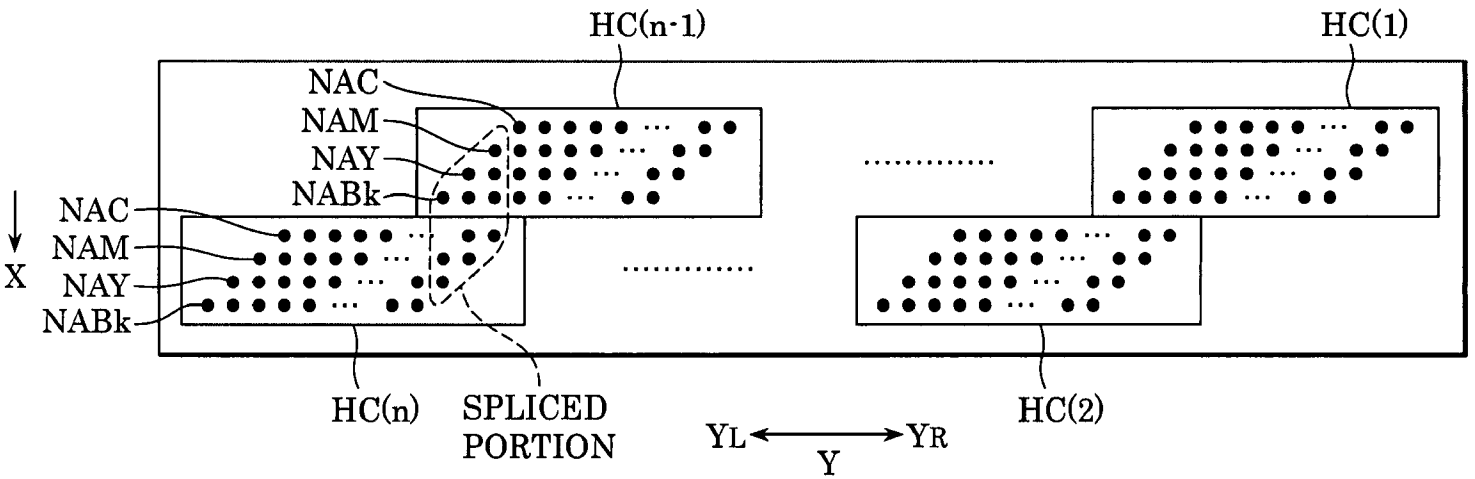
FIG. 18 PRIOR ART
FIG. 18 is a schematic diagram illustrating a construction that restrains splicing streaks developed when recording is performed by the construction shown in FIG. 17.
Figure 19:
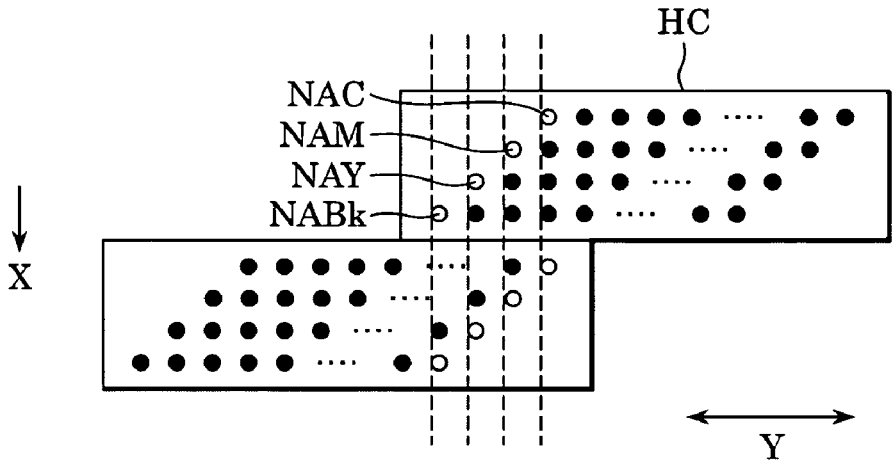
FIG. 19 PRIOR ART
FIG. 19 is a schematic diagram illustrating a problem posed when head chips are disposed so that at least one or more ink discharge ports for the same color are overlapped in a spliced portion between head chips.
Figure 20:
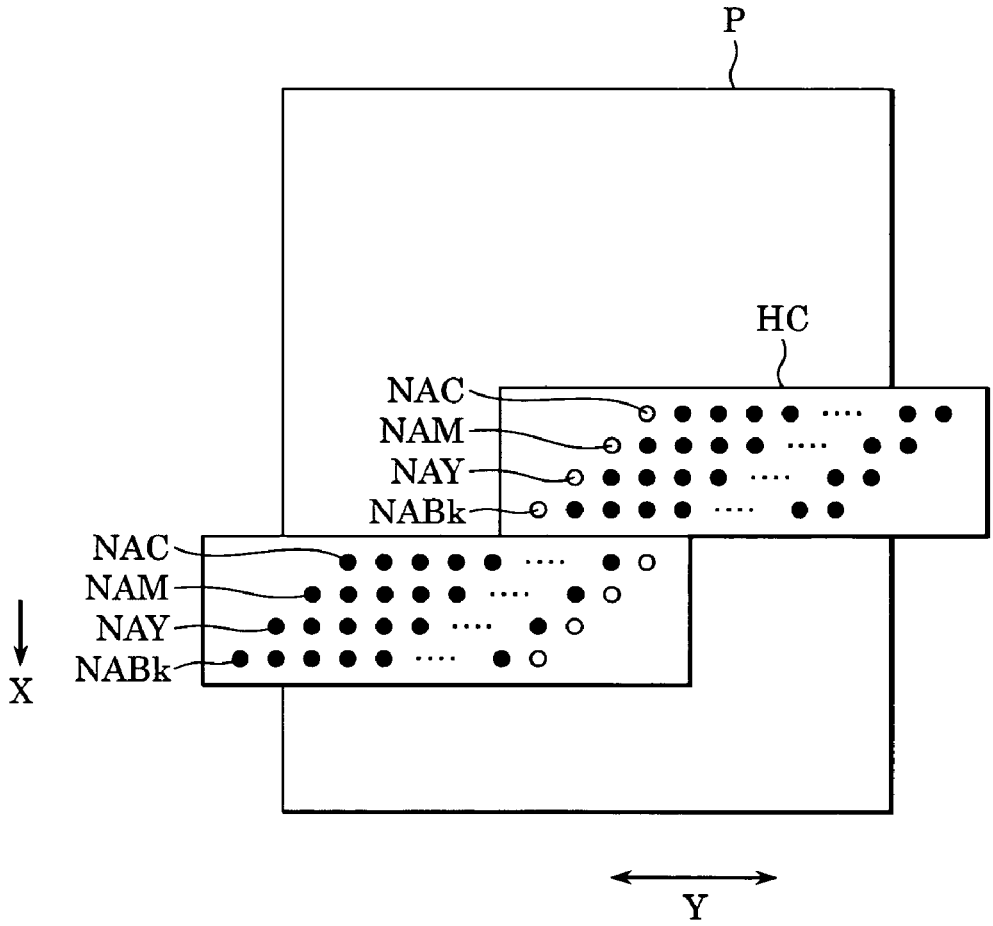
FIG. 20 PRIOR ART
FIG. 20 is a schematic diagram illustrating a new problem posed when a construction for solving the problem explained in conjunction with FIG. 19 is adopted.

FIG. 15 illustrates a case where two rows of nozzles for each of cyan and magenta colors are provided, and the nozzles themselves are also staggered in a head chip. More specifically, the nozzle resolution, i.e., the nozzle-to-nozzle pitch, of one of the two rows is set to about 600 dpi, while the nozzle resolution of the other is also set to about 600 dpi. These two rows are staggered by half a pitch to provide a nozzle resolution equivalent to about 1200 dpi. FIG. 16 illustrates an example wherein the nozzle chips are arranged in the staggered manner to constitute a lengthy head. The same arrangement has been applied to the rows for yellow and black inks to constitute the lengthy head.

In this case also, the nozzles in end portions are set unusable, as in the embodiments described above. It is needless to say that the nozzles in end portions may be set unusable by means of an electric circuit or may be removed beforehand, as described above.

As an alternative example of the configuration examples described above, the nozzles in end portions that are not used are provided, but are formed as "dummy nozzles" that do not have the discharging function. The dummy nozzles here refer to nozzles that are built in but not capable of generating discharge energy. This can be implemented by forming a heater board so that it does not have heaters corresponding to the dummy nozzles or has no electrical connection thereto.

In the above example, two discharge ports of the same color nozzles overlap. However, the number of overlapping discharge ports may be set to one or more as long as the deflection at ends can be effectively restrained.

Furthermore, the above description has referred to the ink-jet heads using elements, namely, the heaters, for generating heat energy as the energy used for discharging ink. Obviously, however, the present invention can be applied to other types of ink-jet heads, e.g., an ink-jet head that uses piezoelectric elements to produce mechanical energy so as to discharge ink.

In the above examples, the constructions have been shown that use head chips or ink-jet heads for the four colors, namely, cyan, magenta, yellow, and black; however, it is needless to say that the types or color tones (colors and densities) of inks are not limited thereto. The constructions may use special color inks of pale magenta or pale cyan having low densities or red, green and blue.

Furthermore, the above examples have described the cases where the present invention has been applied to a line printer wherein discharge ports or head chips are disposed in the area corresponding to the width of the recording material. However, the present invention is effectively applicable to a serial type ink-jet recording method, in which relative scanning of the ink-jet head in a different direction from the direction in which discharge ports are arranged and relative feed of a recording material in a direction orthogonal to the above direction are repeated to perform a recording operation, as long as a plurality of head chips is disposed to obtain a desired length of the ink-jet head. A specific example is a serial type ink-jet recording method in which the ink-jet head mounted on a carriage or the like is scanned in the X direction and a recording material is repeatedly fed in the Y direction for each predetermined length in FIG. 6.

According to the present invention, when performing one-pass recording by a spliced head that has head chips capable of discharging inks of two or more different colors on the same head chip, the head chips being spliced in a staggered manner, the occurrence of "splice streaks" attributable to overlap of spliced portions of different colors can be restrained, allowing high quality recording to be achieved that is free of "white streaks" due to "deflection at ends" or "uneven colors" caused by different landing orders of ink droplets in spliced portions of different colors.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2003-417364 filed Dec. 15, 2003, which is hereby incorporated by reference herein.

What is claimed is:

1. An ink-jet head comprising:

at least first and second head chips, each of the first and second head chips including ports arranged at least along first and second rows having end portions, the first and second rows adjoining each other, wherein at least one of the first row of ports includes a first discharge port selectively configured to discharge a first color ink, wherein at least one of the second row of ports includes a second discharge port selectively configured to discharge a second color ink having a different color from the color of the first color ink, wherein the first and second head chips adjoin each other such that the first and second rows of ports of the first head chip are staggered relative to the first and second rows of ports of the second head chip at their end portions along a direction in which the ports are disposed, wherein at the end portions of the first and second head chips, the first discharge port of the first head chip overlaps with the second discharge port of the second head chip in a direction orthogonal to the direction in which the ports are disposed, and the second discharge port of the first head chip does not overlap with the first discharge port of the second head chip in a direction orthogonal to the direction in which the ports are disposed, and wherein landing of droplets discharged from the ports at the end portions of the first and second head chips on a recorded material is performed firstly with respect to the first color ink, and then with respect to the second color ink, in order.

2. An ink-jet head according to claim 1, further comprising:

at least third and fourth head chips:

each of the third and fourth head chips including ports arranged at least along third and fourth rows having end portions, wherein at least one of the third row of ports includes a third discharge port selectively configured to discharge a third color ink, wherein at least one of the fourth row of ports includes a fourth discharge port selectively configured to discharge a fourth color ink, wherein the third and forth head chips adjoin each other such that the third and fourth rows of ports of the third head chip are staggered relative to the third and fourth rows of ports of the forth head chip at their end portions, and wherein, at the end portions of the third and forth head chips, the fourth discharge port of the third head chip overlaps with the third discharge port of the fourth head chip.

3. An ink-jet head according to claim 2, wherein the third color ink has a low optical reflection density.

4. An ink-jet head according to claim 1, wherein the first and second discharge ports are selected from the first and second rows of ports, respectively, in advance.

5. An ink-jet head according to claim 1, wherein at the end portions of the first and second head chips, the first discharge port of the first head chip overlaps with the first discharge port of the second head chip, and the second discharge port of the first head chip overlaps with the second discharge port of the second head chip.

6. An ink-jet head according to claim 1, wherein at the end portions of the first and second head chips, a plurality of the discharge ports in the first and second head chips overlap.

7. An ink-jet recording apparatus comprising:

the ink-jet head according to claim 1; and a mechanism for feeding the recording material relative to the ink-jet head.

8. An ink-jet recording apparatus according to claim 7, further comprising means for selecting ports of the first and second rows of ports to be the first and second discharge ports, respectively.

* * * * *